US006414706B1

(12) United States Patent
Allen et al.

(10) Patent No.: US 6,414,706 B1
(45) Date of Patent: Jul. 2, 2002

(54) HIGH RESOLUTION DIGITAL PRINTING WITH SPATIAL LIGHT MODULATOR

(75) Inventors: John B. Allen, Lucas; William E. Nelson, Dallas; Albert Barge Smanio Coit, Carrollton; Curt R. Raschke, Collin, all of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/428,246

(22) Filed: Oct. 27, 1999

Related U.S. Application Data

(60) Provisional application No. 60/106,273, filed on Oct. 30, 1998.

(51) Int. Cl.[7] ..... B41J 2/47
(52) U.S. Cl. ..... 347/239; 347/255
(58) Field of Search ..... 347/134, 135, 347/239, 241, 255, 256; 348/755, 770, 771; 359/224

(56) References Cited

U.S. PATENT DOCUMENTS 4,596,992 A * 6/1986 Hornbeck ..... 347/134
5,455,602 A 10/1995 Tew ..... 347/239
5,461,410 A 10/1995 Venkateswar et al. ..... 347/240
5,696,549 A 12/1997 Nelson ..... 347/239
5,774,252 A * 6/1998 Lin et al. ..... 359/224

OTHER PUBLICATIONS

Schein, L.B., Electrophotography and Development Physics, Second Edition, Springer–Verlag Berlin Heidelberg 1988, 1992, pp. 125–132.

Allen et al., "Comparison of the Single Pixel Development of DMD (Digital Micromirror Device) and Laser Exposure Modules in Electrophotographic Printing", Journal of Imaging Science and Technology, vol. 43, No. 4, Jul./Aug. 1999.

* cited by examiner

*Primary Examiner*—Hai Pham
(74) *Attorney, Agent, or Firm*—Charles A. Brill; Wade James Brady, III; Frederick J. Telecky, Jr.

(57) ABSTRACT

A method of modeling and enhancing the print quality of digital printing, including both electrophographic printing and photofinishing. Pixels are printed with a device such as a DMD, whose pixels provide a steep-sided intensity versus displacement curve of each light spot on the image plane. Holes placed in the pixel can be used to place a dip in the top of the curve, a feature especially useful for electrophotographic printing. The effect of this hole on the image plane can also be flattened, a feature than may be especially useful for photofinishing. The steep-sided intensity curve facilitates the ability to model and predict pixel size.

20 Claims, 5 Drawing Sheets

HIGH RESOLUTION DIGITAL PRINTING WITH SPATIAL LIGHT MODULATOR

This claims priority under 35 USC § 119(e)(1) of provisional application No. 60/106,273 filed Oct. 30, 1998.

TECHNICAL FIELD OF THE INVENTION

This invention relates to digital printing, which includes both electrophotographic printing and photofinishing, and more particularly to a method of optimizing the print process for certain kinds of spatial light modulators, thereby improving print quality.

BACKGROUND OF THE INVENTION

Spatial light modulators (SLMs) have found application in many fields, a significant one of which is digital printing. In general, an SLM is an array of light-emitting, light-transmitting, or light-reflecting elements, which are individually addressable, usually with electronic signals. Many SLMs are binary, having an addressing scheme that switches its elements to either an "on" or "off" state to form the image. A characteristic of SLMs is that there is no scanning—all pixels are activated at substantially the same time to generate the entire image or a two-dimensional block of the image, depending on the size of the image and the SLM.

One type of SLM is a digital micro-mirror device (DMD). The DMD has an array of hundreds or thousands of tiny tilting mirrors. To permit the mirrors to tilt, each is attached to one or more hinges mounted on support posts and each is spaced by means of an air gap over underlying addressing circuitry. The addressing circuitry provides electrostatic forces, which cause each mirror to selectively tilt.

For printing applications, the DMD is addressed with exposure data, and in accordance with the data, light is selectively reflected or not reflected from each mirror to a photosensitive surface. In the case of electrophotographic printing, the photosensitive surface is an OPC (organic photoconductive drum) or other photoreceptor, which then transfers a latent image to paper or other printable media. In the case of photofinishing, the photosensitive surface is the photosensitive paper that will bear a printed photograph. It should be noted that DMDs may also be successfully used for the exposure phase of variations of electrophotographic printing, i.e., electrophoretic printing.

For all types of digital printing, the DMD has proven itself to perform well in terms of print quality. Depending on the application, DMD characteristics and operation may be optimized according to consumer expectations of how the output should best appear and to industry demands. For example, for photofinishing applications, the resolution must be sufficiently high to compete with conventional analog photofinishing, yet the process must also be sufficiently efficient to make use of the DMD a cost effective alternative. Parameters such as mirror size and modes of modulation are design choices that can be varied according to the particular application. Providing the best design for a particular application requires an accurate model of the output characteristics of the DMD.

SUMMARY OF THE INVENTION

One aspect of the invention is an method of using a spatial light modulator for the exposure phase of digital printing. The spatial light modulator is of a type modeled by a steep-sided intensity/displacement "curve", which represents desirable features of the SLM. Also, the spatial light modulator has at least one hole in the center of each pixel element. The characteristics of the hole(s) are adjusted for optimum print quality, such as by adjusting the number of holes, the location- of the hole,(s), or the size of the hole(s). The characteristics of the hole determine further characteristics of the intensity/displacement curve, namely, the size and shape of a "dip" in the top of the curve. Optics can be used to process the light out of the spatial light modulator, and to thereby retain or flatten this "dip" so as to achieve a desired print quality.

DETAILED DESCRIPTION OF THE INVENTION

DMD Structure and Operation

The following description is in terms of a DMD type spatial light modulator. As explained below, DMDs can be shown to have certain pixel illumination characteristics that result in greatly improved image quality for all types of digital printing, specifically, electrophotographic printing and photofinishing. However, other SLMs may exist or could be developed having similar characteristics. In general, the invention applied to any pixilated spatial light modulator that uses a white light source to light spots having the steep-profiled and non-overlapping illumination characteristics described herein.

Figure 1:
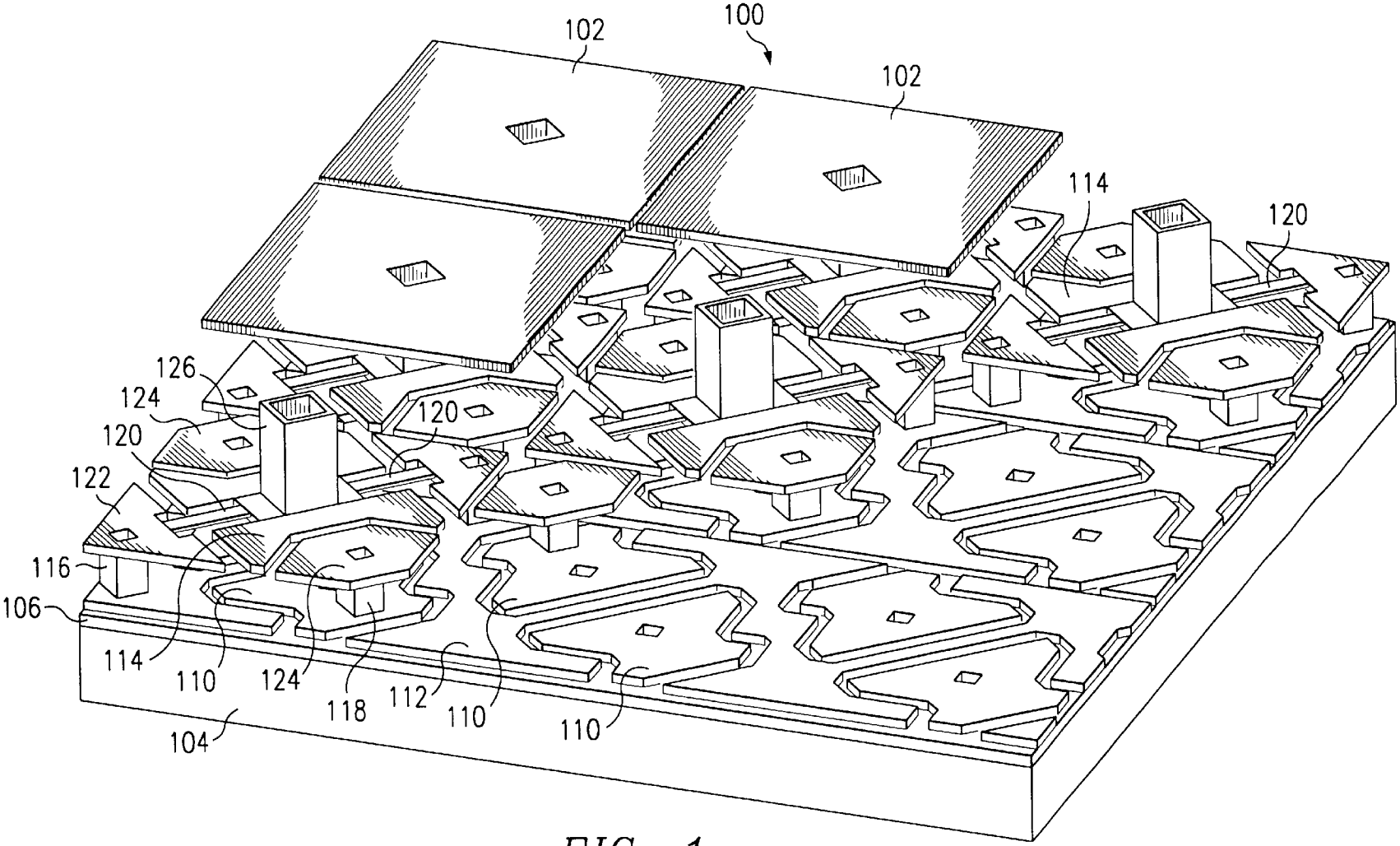
FIG. 1 (PRIOR ART)
FIG. 1 illustrates a portion of a digital micro mirror device (DMD) array.
Figure 2:
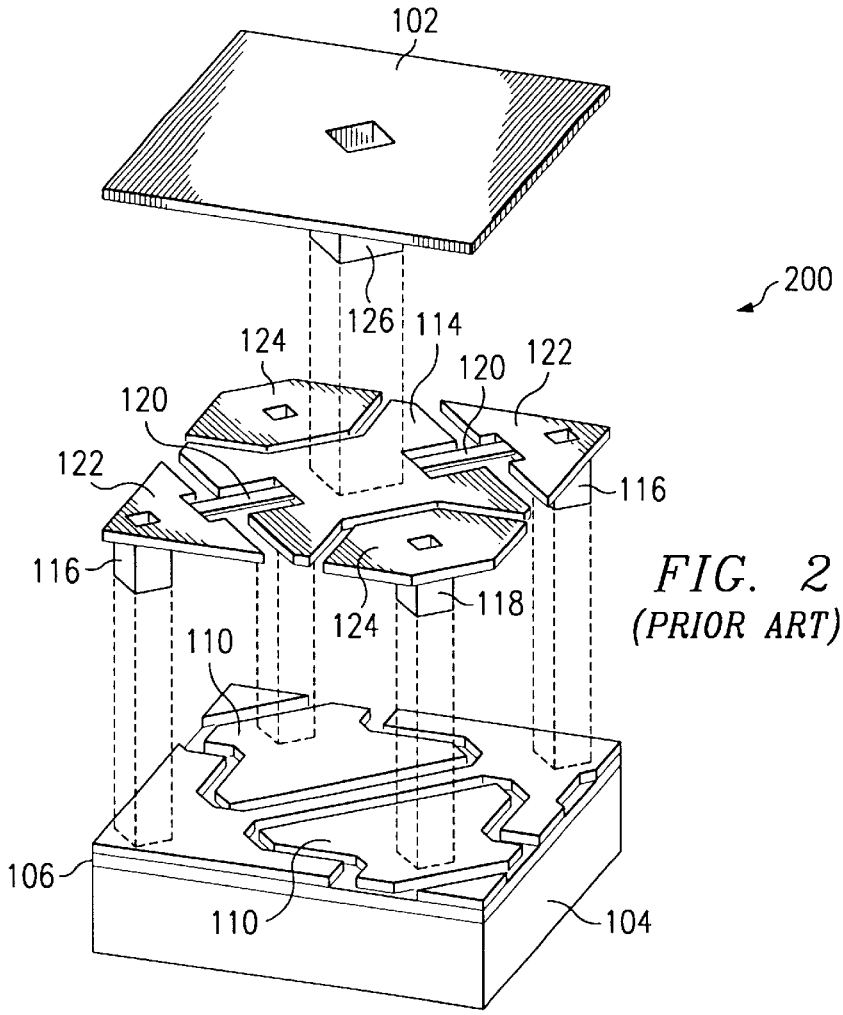
FIG. 2 (PRIOR ART)
FIG. 2 illustrates a single mirror element of the DMD of FIG. 1.

FIG. 1 illustrates a portion of a DMD array 100 and FIG. 2 illustrates a single mirror element 200. The DMD embodiment of FIGS. 1 and 2 is known as a "hidden-hinge" DMD, because each mirror element is characterized by the fabrication of the mirror on a support (referred to herein as a "spacervia") above torsion beams that permit the mirror to tilt. As explained below, the elevated mirror covers the torsion beams, torsion beam supports, and a rigid yoke connecting the torsion beams and mirror support. An advantage of the hidden-hinge design is an improved contrast ratio of images produced by the DMD. Contrast ratios of several hundred to one are now readily achieved.

Referring to FIG. 1, a typical hidden-hinge DMD 100 is a two-dimensional array of DMD elements. This array often includes more than a thousand DMD rows and columns of DMDs. FIG. 1 shows a small portion of a DMD array with several mirrors 102 and spacervias 126 removed to show the underlying mechanical structure.

DMD 100 is fabricated on a semiconductor, typically silicon, substrate 104. Electrical control circuitry is typically fabricated in or on the surface of the semiconductor substrate 104 using standard integrated circuit process flows. This circuitry typically includes, but is not limited to, a memory cell associated with and typically underlying each mirror 102 and digital logic circuits to control the transfer of the digital image data to the underlying memory cells voltage driver circuits to drive bias and reset signals to the mirror superstructure may also be fabricated on the DMD structure, or may be external to the DMD. Image processing and formatting logic is also formed in the substrate 104 of some designs.

Figure 12:
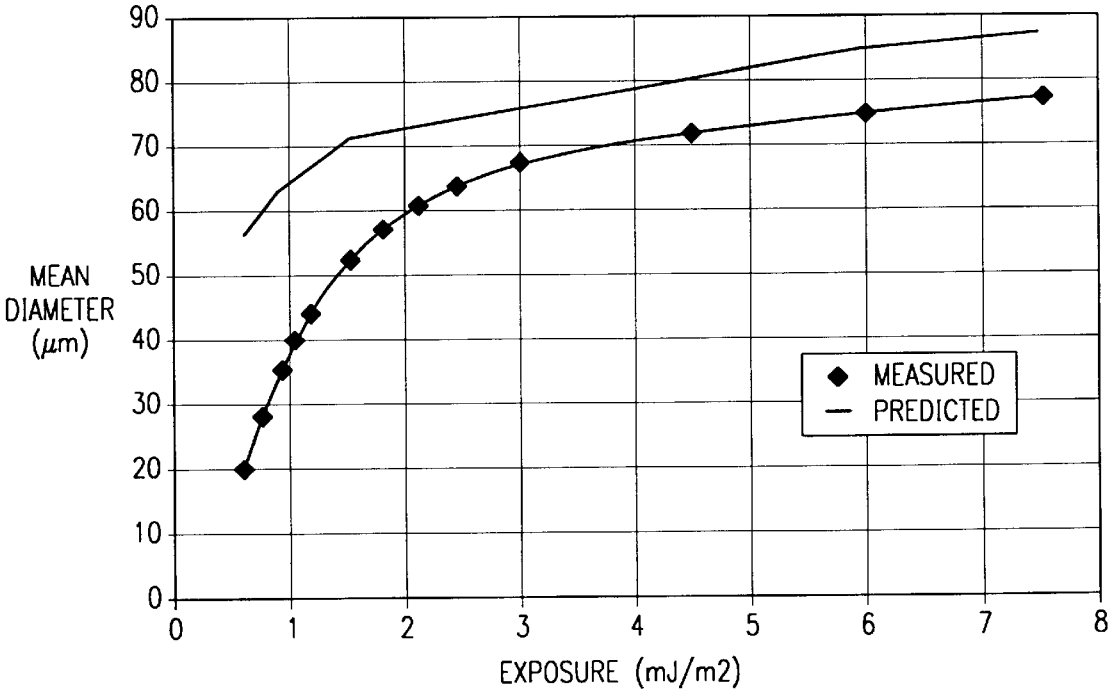
FIG. 12 illustrates how an analysis of pixel characteristics of the DMD can be used to predict pixel diameter.

Older DMD configurations used a split reset configuration which allows several DMD elements to share one memory cell. In FIG. 12, measured mean pixel diameters are compared to predicted values, thus reducing the number of memory cells necessary to operate a very large array, and making more room available for voltage driver and image processing circuitry on the DMD integrated circuit. Split reset is enabled by the bistable operation of a DMD, which allows the contents of the underlying memory to change without affecting the position of the mirror 102 when the mirror has a bias voltage applied. Newer generations of DMDs, however, have evolved to non-split reset architectures that use one memory cell for each DMD element. For the purposes of this description, addressing circuitry is considered to include any circuitry, including direct voltage connections and shared memory cells, used to control the direction of rotation of a DMD mirror.

The silicon substrate 104 and any necessary metal interconnection layers are isolated from the DMD superstructure by an insulating layer 106, which is typically a deposited silicon dioxide layer on which the DMD superstructure is formed after the silicon dioxide layer is planarized and polished to a high degree of flatness. Vias 108 are opened in the oxide layer to allow electrical connection of the DMD superstructure with the electronic circuitry formed in the substrate 104.

The first layer of the superstructure is a metalization layer, typically the third metalization layer, often called M3. Two metalization layers, often called M1 and M2, are typically required to interconnect the circuitry fabricated on the substrate. This metalization layer is deposited on the insulating layer and patterned to form address electrodes 110 and a mirror bias connection 112. Some micromirror designs have landing electrodes that are separate and distinct structures but are electrically connects to the mirror bias connection 112. Landing electrodes limit the rotation of the mirror 102 and prevent the rotated mirror 102 or hinge yoke 114 from touching the address electrodes 110, which have a voltage potential relative to the mirror 102. If the mirror 102 contacted the address electrodes 110, the resulting short circuit could fuse the torsion hinges 116 or weld the mirror 102 to the address electrodes 110, in either case ruining the DMD. Since the same voltage is always applied to both the landing electrodes and the mirrors 102, the mirror bias connection and the landing electrodes are preferably combined in a single structure when possible. The mirror bias connection 112 typically includes regions called landing sites which mechanically limit the rotation of the mirror 102 or a hinge yoke 114. These landing sites are often coated with a material chosen to reduce the tendency of the mirror 102 and torsion hinge yoke 144 to stick to the landing site.

Mirror bias/reset voltages travel to each mirror 102 through a combination paths using both the mirror bias/reset metalization 112 and mirrors and torsion beams of adjacent mirror elements. Split reset designs require the array of mirrors to be subdivided into multiple subarrays each having an independent mirror bias connection. The landing electrode/mirror bias 112 configuration shown in FIG. 1 is ideally suited to split reset applications since the DMD elements are easily segregated into electrically isolated rows or columns simply by isolating the mirror bias/reset layer between the subarrays.

A first layer of supports, typically called spacervias, is fabricated on the metal layer forming the address electrodes 110 and mirror bias connections 112. These spacervias, which include both hinge support spacervias 116 and upper address electrode spacervias 118, are typically formed by spinning a thin spacer layer over the address electrodes 110 and mirror bias connections 112. This thin spacer layer is typically a 1 $\mu$m thick layer of positive photoresist. After the photoresist layer is deposited, it is exposed, patterned, and deep UV hardened to form holes where the spacervias will be formed. This spacer layer, as well as a thicker spacer layer used later in the fabrication process, are often called sacrificial layers since they are used only as forms during the fabrication process and are removed from the device prior to device operation.

A thin layer of metal is sputtered onto the spacer layer and into the holes. An oxide is then deposited over the thin metal layer and patterned to form an etch mask over the regions that later will form hinges 120. A thicker layer of metal, typically an aluminum alloy, is sputtered over the thin layer and oxide etch masks. Another layer of oxide is deposited and patterned to define the hinge yoke 114, hinge cap 122, and the upper address electrodes 124. After this second oxide layer is patterned, the two metals layers are etched simultaneously and the oxide etch stops removed to leave thick rigid hinge yokes 114, hinge caps 122, and upper address electrodes 124, and thin flexible torsion beams 120.

A thick spacer layer is then deposited over the thick metal layer and patterned and etched to define holes in which mirror support spacervias 126 will be formed. This spacer layer is typically a 2 $\mu$m thick layer of positive photoresist. A layer of mirror metal, typically an aluminum alloy, is sputtered on the surface of the thick spacer layer and into the holes in the thick spacer layer. This metal layer is then patterned to form the mirrors 102 and both spacer layers are removed using a plasma etch. The spacervias 126 provide a mechanical and electrical connection between mirrors 102 and the underlying metal layer.

The above-described process results in a hole 102*a* in each mirror 102. As explained below, hole 102 has desirable effects for printing applications. The effect of the hole may be enhanced for electrophotographic printing applications, and may be "flattened for photofinishing applications.

Once the two spacer layers have been removed, the mirror 102 is free to rotate about the axis formed by the torsion hinge 120. Electrostatic attraction between an address electrode 110 and a deflectable rigid member, which in effect forms the two plates of an air gap capacitor, is used to rotate the mirror structure. Depending on the design of the micromirror device, the rigid member is the torsion beam yoke 114, beam, mirror 102, both the yoke 114 and beam or mirror 102, or a beam attached directly to the torsion beams. The upper address electrodes 124 also electrostatically attract the rigid member.

The force created by the voltage potential is a function of the reciprocal of the distance between the two plates. As the rigid member rotates due to the electrostatic torque, the torsion beam hinges resist with a restoring torque, which is an approximately linear function of the angular deflection of the torsion beams. The structure rotates until the restoring torsion beam torque equals the electrostatic torque, or until the rotation is mechanically stopped by contact between the rotating structure and a stationary portion of the DMD, typically at a rotation of 10° to 12° in either direction. As mentioned above, most micromirror devices are operated in a digital mode wherein sufficiently large bias voltages are used to ensure full deflection of the micromirror superstructure.

Micromirror devices are generally operated in one of two modes of operation. The first mode of operation is an analog mode, sometimes called beam steering, wherein the address electrode is charged to a voltage corresponding to the desired deflection of the mirror. Light striking the micromirror device is reflected by the mirror at an angle determined by the deflection of the mirror. Depending on the voltage applied to the address electrode, the cone of light reflected by an individual mirror is directed to fall outside the aperture of a projection lens, partially within the aperture, or completely within the aperture of the lens. The reflected light is focused by the lens onto an image plane, with each individual mirror corresponding to a location on the image plane. As the cone of reflected light is moved from completely within the aperture to completely outside the aperture, the image location corresponding to the mirror dims, creating continuous brightness levels.

The second mode of operation is a digital mode. When operated digitally, each micromirror is fully deflected in either of the two directions about the torsion beam axis. Digital operation uses a well defined bias voltage to ensure the mirror is fully deflected. Since it is advantageous to drive the address electrode using standard logic voltage levels, a bias voltage, typically a negative voltage, is applied to the mirror metal layer to increase the voltage difference between the address electrodes and the mirrors after addressing the mirrors with a lower, CMOS compatible voltage, typically +5 V. Use of a sufficiently large mirror bias voltage, a voltage above what is termed the collapse voltage of the device, ensures the mirror will deflect to the closest landing electrodes even in the absence of an address voltage. Therefore, by using a large mirror bias voltage, the address voltages need only be large enough to deflect the mirror slightly, and predetermine the deflection direction, e.g. establish the mirror cell as an "off-state" or an "on-state".

Digital Printing Using DMDs

Figure 3:
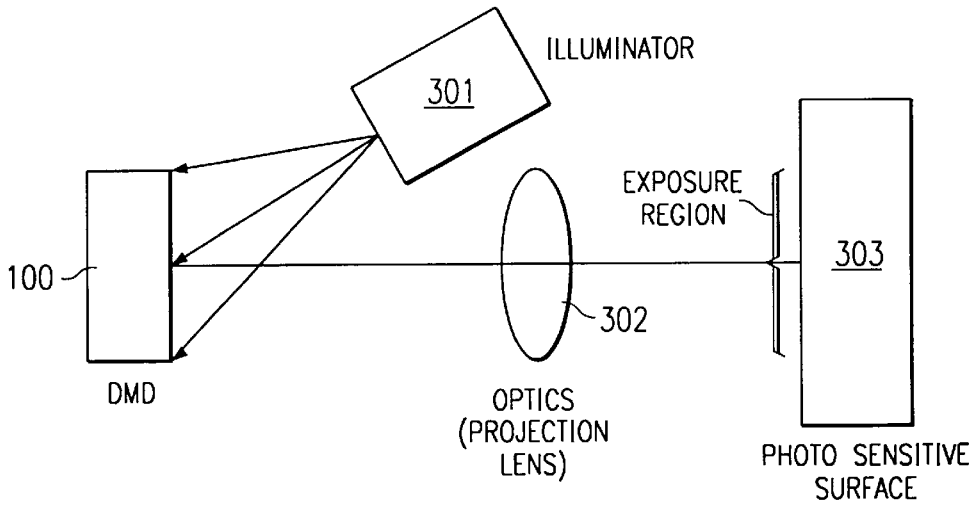
FIG. 3 is a diagram of the basic principles of the exposure phase of digital printing with an SLM.

FIG. 3 is a rudimentary illustration of the basic principles of the exposure phase of digital printing with an SLM, such as DMD 100. As explained below, the exposure phase is used to expose a photosensitive surface, which is a photoreceptor drum in the case of electrophotographic printing and is a photosensitive material such as silver halide paper in the case of photofinishing.

It is assumed that the image to be printed is represented in digital form and formatted for loading to the memory cells of DMD 100. The format of the data may depend on various modulation schemes, used for printing greyscale.

A light source 301 is positioned at an angle equal to twice the DMD's angle of rotation so that mirrors rotated toward the light source reflect light in a direction normal to the surface of the micromirror device and into the aperture of projection optics 302 (shown as a single projection lens). This creates a bright pixel (also referred to as a "light spot") on the photosensitive surface 303. Mirrors rotated away from the light source reflect light away from projection lens 301. This leaves the corresponding pixel dark.

Projection lens 302 is a high resolution projection lens. Unlike laser exposure systems, where the lens and scanner are kept small to reduce costs, in a DMD exposure system, lens 302 may be a large aperture lens. A typical projection lens 302 for electrophotographic printing is a F5.6 lens with a one inch aperture diameter.

Typically, DMD 100 is as wide as the image to be printed but has fewer rows. For example, a typical photofinishing application might produce prints that are 4×6 inches in size, with a resolution of 320 dpi (dots per inch). In this case, DMD 100 would have a horizontal resolution of 1280 mirror elements.

Rows of the image are successively printed as the photosensitive material moves in the process direction. In the case of electrophotographic printing, the drum rotates, whereas in the case of photofinishing the paper is carried past the exposure area on a flat plane. A typical number of rows printed at one time might be 64.

As discussed below, the relationship between rows of the DMD 100 and rows of the exposure area permits various techniques to be used to provide greyscale. For example, in the case of electrophotographic printing, the 64 rows of the DMD 100 permit each row of the image to be successively printed as many as 64 times, resulting in an accumulation of toner at the desired pixels and hence those pixels are darker.

For electrophotographic printing, photosensitive surface 303 is an electrostatically charged cylinder (a photoreceptor drum) having an insulating photosensitive coating applied to it. When exposed to light, portions of the photosensitive surface become conductive and discharge the static charge applied to the exposed portions, forming a latent image represented by the remaining charge distribution. The photoreceptor drum 303 rotates past a toner developer system (not shown), where toner particles are attracted to the imaged portions of the drum 303 that retain an appropriate charge. The toner is then transferred to an electrically charged sheet of paper where it is fused on the paper. Greyscale is produced with various modulation techniques. Both dot area and dot intensity modulation techniques, or a combination of these, may be used. Color images are produced by sequentially repeating the exposure and development steps for images and toners of different colors, which combine to form the desired colored image.

Additional information about electrophotographic printing using DMDs is provided in the following patents: U.S. Pat. No. 5,455,602, to Tew, entitled "Combined Modulation Schemes for Spatial Light Modulators"; U.S. Pat. No. 5,461,410, to Ventkateswar, et al., entitled "Gray Scale Printing Using Spatial Light Modulators"; and in U.S. Pat. No. 5,696,549 to Nelson, entitled "Method of Reducing Print Artifacts".

For photofinishing, the photosensitive surface 303 is a suitable paper or other media, such as silver halide paper. The paper is moved past the exposure region to allow the entire length of the image to be exposed. Greyscale is produced with various modulation techniques. For photofinishing, dot intensity modulation is especially suitable to provide the contone images desired for prints. Color images are created either by using multiple DMD arrays to provide single color illumination or by using a color wheel. The silver halide paper (other photosensitive media) contains particles that respond to the different illumination colors.

Additional information about photofinishing using DMDs is provided in U.S. patent Ser. No. 09/221,517, entitled "Photofinishing Utilizing Modulated Light Source Array" assigned to Texas Instruments Incorporated and incorporated by reference herein.

DMD Pixel Illumination Characteristics

As explained further below, the elements of a DMD have unique pixel illumination characteristics. A first characteristic is the non-Gaussian steep-sided profile of the light energy distribution from each element. A second is that the spots are non overlapping.

Figure 4:
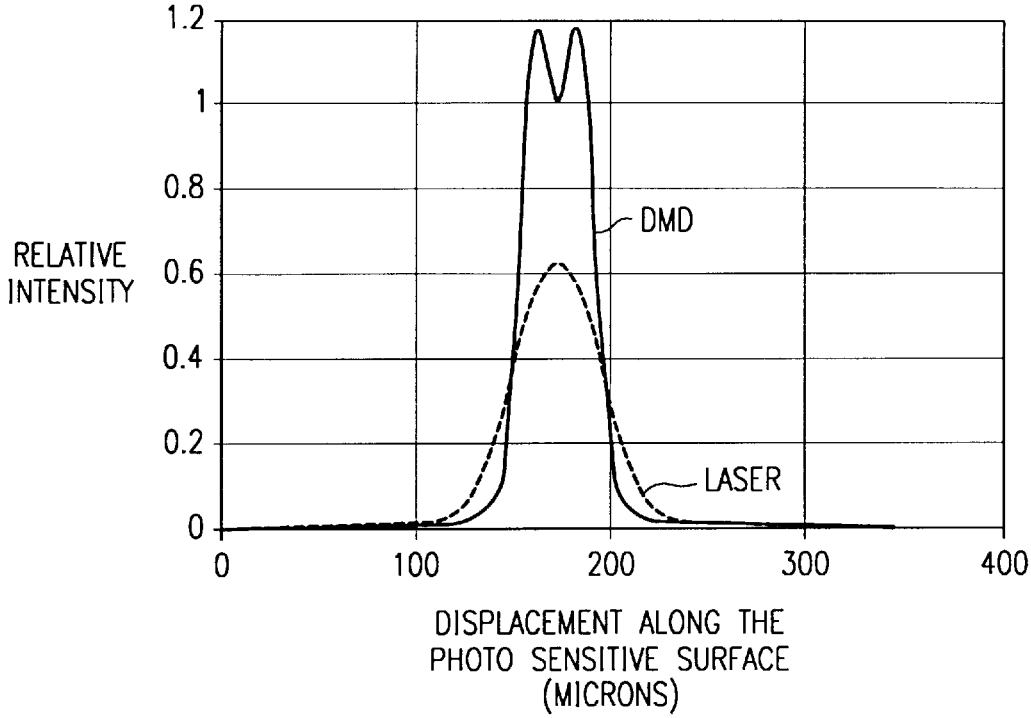
FIG. 4 compares the image produced by a single mirror element (pixel) of a DMD exposure module to that produced by a pixel of a laser exposure module.

FIG. 4 compares the image produced by a single mirror element (pixel) of a DMD exposure module to that produced by a laser exposure module. Both exposure modules are for 600 dpi images, and the images are normalized to the same spatially integrated intensity, i.e., the same power in both beams. The DMD exposure module produces a tighter and more intense single pixel image than does the laser exposure module. The laser exposure module image is a Gaussian function whose width is 85 microns (full width at $1/e^2$ points).

FIG. 4 assumes the pixel illumination out of the optics 302 of the exposure module. As stated above in connection with FIG. 3, DMD exposure systems permit the use of a large aperture lens, which preserves the illumination effect of the square edges of the pixel elements. The dip in the center of the intensity curve results from a 3 micron hole in the center of the micromirror element, described above in connection with FIGS. 1 and 2. As explained below, for some applications, it may be desirable to "flatten" the dip with the exposure module optics, whereas in other applications, it may be desirable to retain the dip. Also, the optimal size of the hole, and hence the size of the dip, may depend on the application, i.e., electrophotographic printing versus photofinishing.

As indicated by FIG. 4, each DMD pixel produces a sharp edged, highly resolved, non-intrusive optical spot, with a gap between it and other optical spots. As explained below, this has beneficial effects for both electro-photographic printing and photofinishing. In comparison, the Gaussian light spots produced by other light sources, such as lasers, tend to overlap with each other causing undesired pixel interaction on the photosensitive material.

Effect of Pixel Illumination Characteristics on Electrophotographic Printing

The steep profile of the energy distribution from DMD elements 200, when combined with the electrostatics involved in electrophotographic printing, result in improved image quality. As explained below, when a DMD is used for exposing a photoreceptor drum, the toner tends to concentrate in the center of each light spot.

Development systems used in electrophotographic printing deposit charged toner onto the photoreceptor, controlled by a variation in the electric field whose source is the variation in the local photoreceptor charge density produced during exposure. In typical systems, the toner is charged by mixing it with a carrier. Carrier beads are transported around a roller, which rolls past the photoreceptor drum. In the gap between the roller and the drum, a magnetic field from within the roller causes the carrier beads to form a chain. At the end of the toner chain, toner particles contact the photoreceptor drum and "develop" by transferring from the carrier to the drum.

Previous studies have modeled electric field patterns for developing solid areas, that is, areas printed by multiple pixels. It has been assumed that development occurs if the forces attracting toner to the photoreceptor exceed the forces attracting the toner to the carrier, taking into account the build up of charge on the carrier. Schein, *Electrophotography and Development Physics,* pp 125–132, Laplacian Press, 1992. The latent image on the drum consists of surface charge patterns on the drum, and produces electric field lines that connect the surface charges to the image charges in the ground plane of the photoreceptor. In the absence of a counter electrode (the roller), external electric fields appear in the form of fringe fields around the edges of charged areas. When the roller approaches, the field lines are drawn outward from the photoreceptor surface so as to attract toner.

Figure 5:
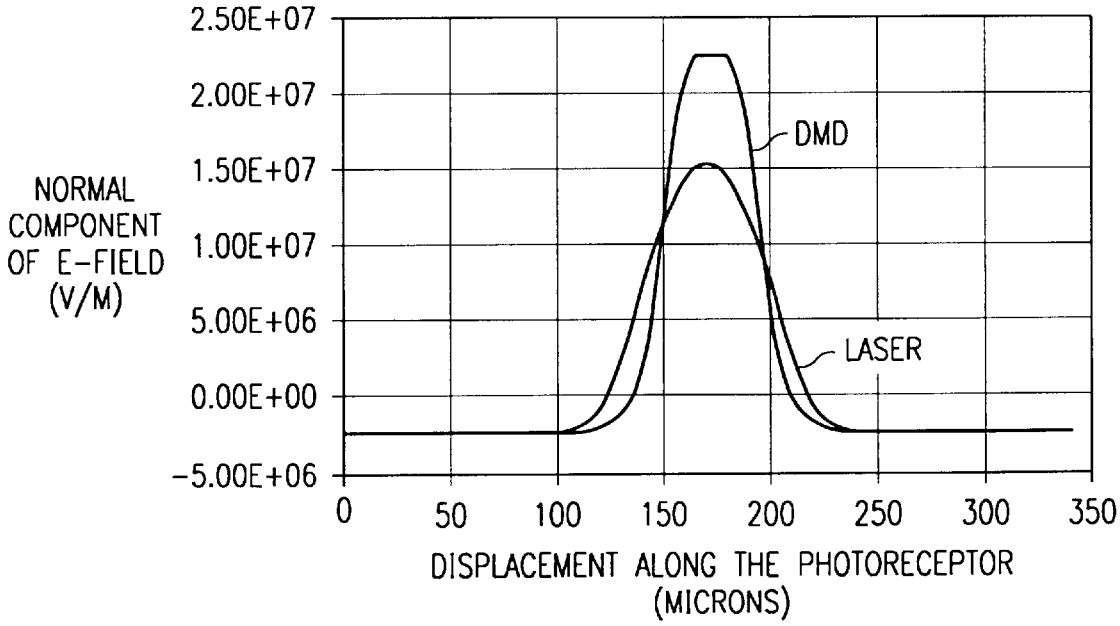
FIGS. 5 and 6 illustrate the extension of a solid-area development model to a model of a single DMD pixel.
Figure 6:
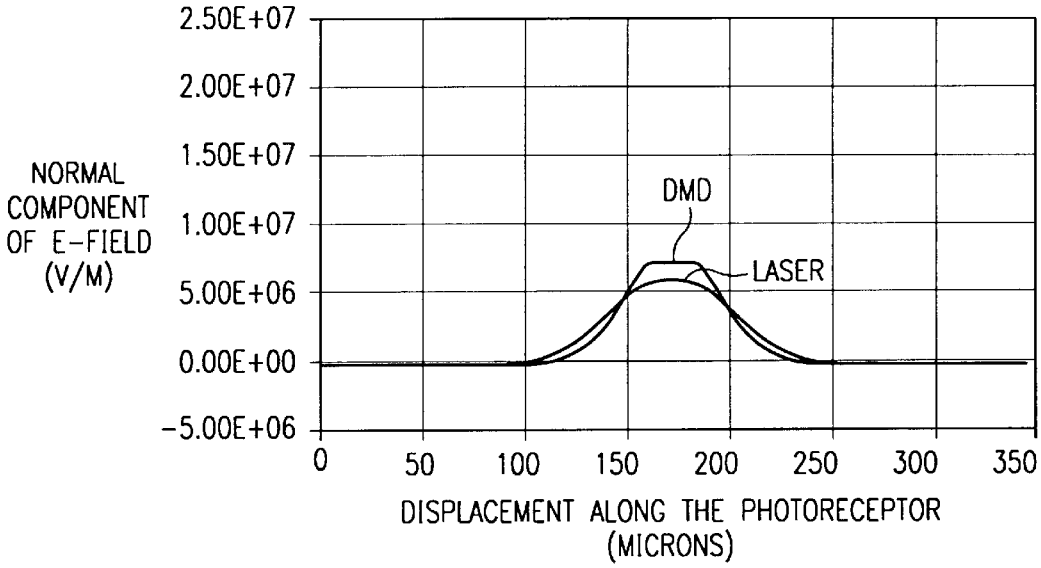

FIGS. 5 and 6 illustrate the extension of the solid-area development model to a model of a single DMD pixel. Specifically, FIGS. 5 and 6 illustrate the normal component of the latent image field at the heights where development of the first two toner layers occur for DMD and laser exposure modules, respectively. The exposure energy density for both modules was 0.0021 joules per $m^2$. The development process used eight micron toner and a high sensitivity photoconductor.

In FIG. 5, the electric field was measured at a height of 4 microns above the photoreceptor, where the first layer of toner senses the electric field (approximately equal to the radius of the toner. In FIG. 6, the electric field was measured at a height of 12 microns, where the second layer of toner senses the electric field (approximately the toner radius about the first layer). As illustrated, the fringe fields produced by the DMD exposure module are stronger and more concentrated than the fields produced by the laser exposure module.

Figure 7:
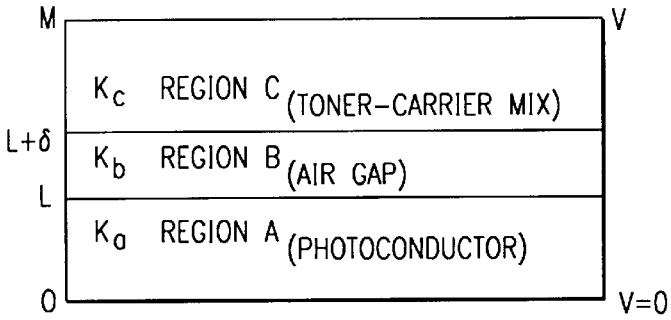
FIG. 7 illustrates various parameters used to compute the normal component of the electric field above a photoconductor, as created by a single pixel.

FIG. 7 illustrates various parameters used to compute the normal component of the electric field at a height h above a photoconductor, as created by a single pixel. The parameters Ka, Kb, and Kc are dielectric constants of the photoconductor, air gap, and toner carrier mix, respectively. The dimension L is the photoconductor thickness and the dimension M is the gap width. The Schein reference, cited above, sets out similar calculations for solid areas as opposed to pixel areas. A spread function is derived relating a sinusoidal charge density on the photoconductor to the normal component of the electric field above the photoconductor. LaPlace's equation is solved for the three layers. Boundary conditions are invoked that potential and electrical displacements are continuous across a dielectric boundary.

Figure 8:
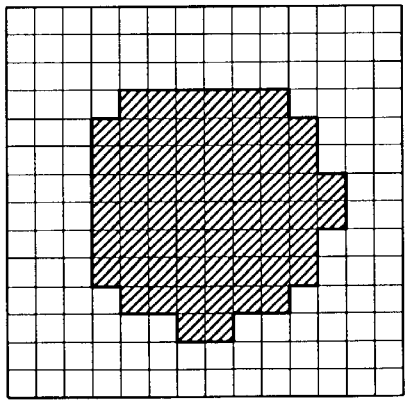
FIGS. 8 and 9 compare the toner distribution in the first developed layer for a DMD and laser exposure module, respectively.
Figure 9:
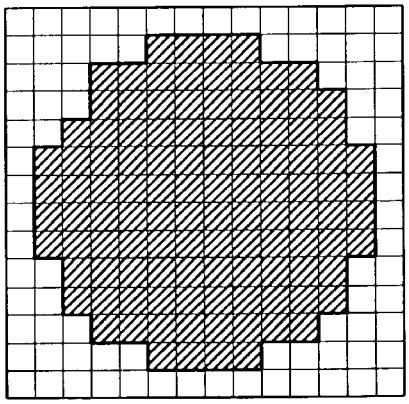
Figure 10:
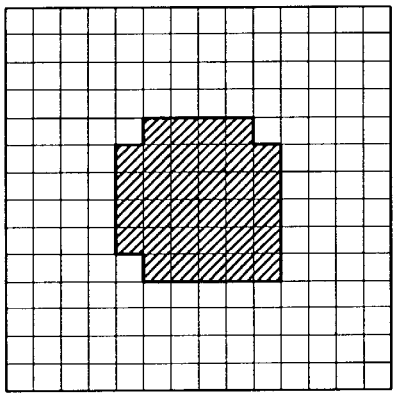
FIGS. 10 and 11 compare the toner distribution in the second developed layer for a DMD and laser exposure module, respectively.
Figure 11:
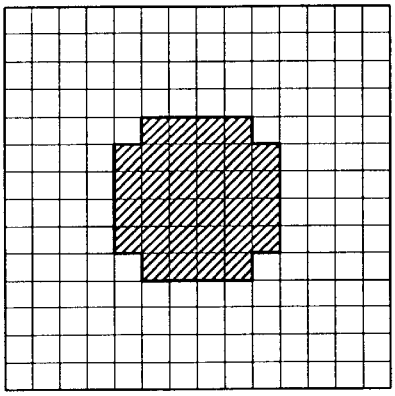

FIGS. 8 and 9 compare the toner distribution in the first developed layer for the DMD and laser exposure modules, respectively. FIGS. 10 and 11 make the same comparison for the second layer. As indicated by FIGS. 8 and 9, the first layer for the DMD and laser exposure, respectively, the predicted developed area of the first layer of the DMD pixel is 50% of the predicted area of the laser pixel. As indicated by FIGS. 10 and 11, the second layer for the DMD and laser exposure, respectively, the second layers are comparable in size. No third layer is formed. The DMD developed pixel is smaller with steeper sides than the laser produced pixel.

FIG. 12 illustrates how the above analysis of pixel characteristics can be used to predict pixel diameter. In FIG. 12, measured pixel diameters are compared to predicted pixel diameters. To obtain the predicted values, for a given exposure intensity, the associated displacement curve is determined. Referring again to FIG. 5, toner can be expected to be attracted to the area under the intensity curve. Thus, the diameter of the pixel is defined by the displacement on the x-axis. The steep sides of the curve for DMD-produced pixels permits a higher degree of accuracy than would be the case for predicting laser-produced pixels. As indicated by FIG. 12, the prediction method has a high degree of accuracy at high exposure levels. For lower exposure levels, appropriate adjustments can be modeled and applied.

A threshold on the electric field at the surface of the photoreceptor can be determined and used to further define the pixel diameter. In other words, if at a given location on the photoreceptor the field is greater than the threshold, there is toner development at that location. The threshold permits prediction of how much, if any, of the area under the "tails" of the curve will attract toner.

Referring again to FIG. 4, the hole 102*a* in the center of each mirror 102 results in a dip in the top of the intensity curve. As shown in FIGS. 5 and 6, due to various imperfections during the transfer of energy from light to electrical (including the effect of optics 302) the curve of the electric field representing the effect of this dip may be "flattened". If this flattening were to be eliminated, the results would be advantageous for electrophotographic printing applications. In such applications, the effect of the hole can be preserved to provide an electrical energy profile element with a dip in the top of the curve, and hence, more fringe fields. An example of one approach to retaining the effect of the hole is using an appropriate design of optics 302. Or the hole could be made sufficiently large or deep such that any flattening does not completely eliminate its effect. Regardless of whether the top of the intensity (or energy) curve is dipped or flat, a common characteristic is that it is truncated as compared to a curve having a rounded top, such as that produced by a pixel element having no hole.

The result of retaining the effect of the hole is a higher concentration of charge per pixel. Or conversely, mirror area can be reduced and yet maintain the same total electric field. The same amount of toner will be concentrated on a smaller area. This reduced pixel size permits higher resolution images.

For a given mirror size, higher resolution images can also be accomplished by increasing the size of the hole relative to mirror surface area. The increased size of the hole results in more edge per mirror and hence more fringe fields per pixel. The optimal size is one that is sufficiently large to provide increased fringe fields but not so large so as to degrade contrast or other aspects of image quality.

Another alternative for increasing resolution is to have multiple holes in each mirror 102. Like larger holes, the increased number of holes, increases the mirror edges per pixel. The holes can be arranged in any pattern designed to improve print quality, such as on a 45 degree slant.

For color printing, latent images for each color are illuminated, charged, and developed. These images are overlaid, such that a combination of different colored toner at a pixel results in the desired color. When a DMD 100 is used for the exposure, the toner color particles also exhibit a tendency to concentrate at each pixel location. As the colors are built up, the toner is localized resulting in the desired color without smearing or spreading to other pixels.

Effect of Pixel Illumination Characteristics on Photofinishing

The illumination characteristics of the DMD also have a beneficial result when DMDs are used for photofinishing. For these applications, the DMD illumination characteristics affect on the activation of silver halide paper (or other photosensitive material).

Referring again to FIG. 4, the intensity curve of the light spot produced by the DMD element has a dip, due to the hole in the mirror of the DMD element. For photofinishing applications, it may be desirable to flatten the effect of the hole in each mirror element. For example, optics 302 between the DMD and the image plane could be designed to provide this flattening. The result is not only a steep-sided curve, but a curve whose top is flat and square at the corners. In fact, the "curve" more closely resembles a rectangle. The effect on the image created on the photosensitive medium is to produce a sharper image.

For color photofinishing, DMD provide higher quality color as compared to other light sources, such as laser, which produce Gaussian light spots. Laser-produced light spots tend to overlap, which results in the illumination for a given pixel to be affected by its neighboring pixels. The steep illumination of the DMD pixel avoids this overlap.

Other Embodiments

Although the present invention has been described in detail, it should be understood that various changes, substitutions, and alterations can be made hereto without departing from the spirit and scope of the invention as defined by the appended claims.

What is claimed is:

1. A method of predicting pixel size of a pixel generated by a spatial light modulator of a digital micro-mirror device type, comprising the steps of:

modeling said pixel by a steep-sided curve of intensity versus position along a photo-sensitive surface, the steep-sided curve being substantially linear for substantially the length of said curve and having a dip in its top representing a hole in a micro-mirror element generating the pixel;

calculating a displacement under said curve; and estimating said pixel size as being substantially equal to said displacement.

2. The method of claim 1, further comprising the step of adjusting said pixel size as a function of exposure density at low intensities.

3. The method of claim 1, wherein said intensity curve is substantially linear for intensities above 3 millijoules per meter squared.

4. The method of claim 1, wherein said modeling step accounts for the effect of optics applied to light produced from the micro-mirror element to flatten the dip.

5. A method of modeling illumination generated by a pixel element of a spatial light modulator, comprising the steps of:

modeling said illumination as a steep-sided curve of intensity versus position along a photosensitive surface; and representing said intensity with said curve that is substantially linear for substantially the length of said curve;

wherein the top of said curve is truncated to represent at least one hole in the top surface of said pixel element.

6. The method of claim 5, wherein said intensity curve is substantially linear for intensities above 3 millijoules per meter squared.

7. The method of claim 5, wherein said steep-sided curve has a dip in the top representing a hole in said pixel element.

8. The method of claim 5, wherein said steep-sided curve has a substantially flat top representing the effect of optics applied to light produced from a pixel element having at least one hole.

9. The method of claim 5, wherein said spatial light modulator is a digital micro-mirror device.

10. A method of using a spatial light modulator for an exposure phase of digital printing, comprising the steps of:

providing said spatial light modulator with at least one hole in the center of each pixel element;

adjusting the number, in each said pixel element, of said at least one hole for a desired quality of said printing; and exposing a photosensitive surface with said spatial light modulator.

11. The method of claim 10, wherein said adjusting step comprises:

adjusting the size of said at least one hole.

12. A method of using a spatial light modulator for an exposure phase of digital printing, comprising the steps of:

providing said spatial light modulator with at least one hole in the center of each pixel element;

adjusting the location of said at least one hole for a desired quality of said printing; and exposing a photosensitive surface with said spatial light modulator.

13. The method of claim 12, wherein said adjusting step further comprises:

adjusting the size of said at least one hole.

14. A method of using a spatial light modulator for an exposure phase of digital printing, comprising the steps of:

providing said spatial light modulator with at least one hole in the center of each pixel element;

adjusting the characteristics of said hole for a desired quality of said printing;

flattening the effect of said hole on an image plane at a photosensitive surface;

exposing the photosensitive surface with said spatial light modulator.

15. The method of claim 14, wherein said flattening is accomplished with optical components between said pixel elements and the image plane.

16. The method of claim 14, wherein said adjusting step comprises:

adjusting the size of said at least one hole.

17. A method of using a spatial light modulator for an exposure phase of digital printing, comprising the steps of:

providing said spatial light modulator with at least one hole in the center of each pixel element;

adjusting the characteristics of said hole for a desired quality of said printing;

retaining the effect of said hole on an image plane at a photosensitive surface;

exposing the photosensitive surface with said spatial light modulator.

18. The method of claim 17, wherein said retaining is accomplished with optical components between said pixel elements and the image plane.

19. The method of claim 17, wherein said adjusting step comprises:

adjusting the size of said at least one hole.

20. A digital printing method, using a spatial light modulator of a digital micro-mirror device type to expose a photosensitive surface, comprising the steps of:

loading digital data corresponding to an image to be printed into memory cells associated with the spatial light modulator;

exposing the spatial light modulator with light;

controlling at least one row of pixel elements of the spatial light modulator to reflect light toward the photosensitive surface according to the digital data; and transferring an image corresponding to light received by the photosensitive surface to a medium;

wherein each pixel element has at least one hole having a size and position selected to provide a profile of reflection energy that corresponds to a desired print quality.

* * * * *